United States Patent [19]

Frishauf

[11] Patent Number: 5,052,851

[45] Date of Patent: Oct. 1, 1991

[54] EMERGENCY MAINTENANCE HOLE COVER, AND METHOD OF INSTALLATION

[76] Inventor: Stephen H. Frishauf, 54 Riverside Dr., Apt. 6C, New York, N.Y. 10024-6551

[21] Appl. No.: 542,187

[22] Filed: Jun. 21, 1990

[51] Int. Cl.[5] ..... E02D 19/00

[52] U.S. Cl. ..... 404/25

[58] Field of Search ..... 404/25, 26; 52/20; 49/477; 138/93

[56] References Cited

U.S. PATENT DOCUMENTS

| | | | |
|---|---|---|---|
| 149,246 | 3/1874 | Price et al. . | |
| 1,860,855 | 5/1932 | Gardner | 138/93 |
| 3,294,000 | 12/1966 | Pelsue . | |
| 4,305,679 | 12/1981 | Modi | 404/25 |
| 4,306,665 | 12/1981 | Hickey . | |
| 4,373,381 | 2/1983 | Kulp et al. | 138/93 X |
| 4,492,095 | 1/1985 | Brister | 138/93 X |
| 4,621,941 | 11/1986 | Ditcher . | |
| 4,682,443 | 7/1987 | Demo | 49/477 X |
| 4,826,036 | 5/1989 | Lewis et al. . | |
| 4,867,600 | 9/1989 | Bowman | 404/26 |

FOREIGN PATENT DOCUMENTS 2200288 7/1972 Fed. Rep. of Germany .

*Primary Examiner*—Ramon S. Britts
*Assistant Examiner*—Nancy Connolly
*Attorney, Agent, or Firm*—Frishauf, Holtz, Goodman & Woodward

[57] ABSTRACT

To provide a temporary cover for a maintenance hole (1, 31), over an edge (5) of which cables, hoses or other conduits (3, 83) extend, an inflatable balloon (10, 40, 50, 60, 70, 80) has hollow circumferential portions (41, 51, 61, 71, 81), for example generally in the shape of a tire or hollow disk, connected by a web (12), the balloon having a plan view configuration and dimension to fit into and, upon inflation, over the edge of the maintenance hole, and resiliently engaging around the edge of the maintenance hole, thereby preventing ingress of water, contaminants, animals and the like, without damage to the cables, hoses or conduits. Preferably, the balloon is a unitary structure made of distendable material such as rubber, plastic or the like, which may be fiber or textile reinforced.

19 Claims, 2 Drawing Sheets

EMERGENCY MAINTENANCE HOLE COVER, AND METHOD OF INSTALLATION

FIELD OF THE INVENTION

The present invention relates to an emergency cover for openings in a road, such as maintenance holes, personnel access holes, and the like, which, under adverse conditions, are subject to flooding, and more particularly to such an emergency cover which is light, can be packaged in a small space, and which is suitable for application to manholes of different sizes and configurations.

BACKGROUND

Maintenance holes to provide for access to telephone cables, power cables, gas lines and the like, as usually installed in streets, are covered by heavy metal covers seated on a stepped rim of the manhole. Under emergency conditions, it may be necessary to leave off the heavy metal cover since it may be necessary to run cables, hoses or the like around the edge of the manhole. These cables, hoses, and also air supply tubes for personnel working underground, may be in place for a considerable period of time. If, during that time, it starts to rain, water or snow will fall through the opening of the maintenance hole. If the maintenance hole is installed in a location where water runs down the street, a considerable amount of water may accumulate within the manhole. If electrical or other moisture-sensitive equipment is located within the maintenance hole, damage may result. Further, damage may become extensive if the maintenance hole is connected by conduits to adjacent buildings. Water may run through the conduits into the basement of the buildings, causing basement flooding. The maintenance hole cover usually cannot be replaced, even temporarily, because the heavy metal cover might cut into electrical cables, gas hoses or the like, which are run, under emergency conditions, over the edge of the manhole.

THE INVENTION

It is an object to provide an emergency cover for maintenance holes which essentially prevents the ingress of water, snow or other contaminants to the maintenance holes, while permitting cables, hoses or other conduits to pass over the edge of the maintenance holes to the outside, and to a method of installation of an emergency cover.

Briefly, an inflatable tire-like tube, ring or donut shaped balloon, having, in plan view, a configuration and dimension fitting over the maintenance hole, is arranged to define hollow circumferential portions which, when limp and uninflated, fit into an upper portion of the maintenance hole. The balloon has surface portions which seal themselves against the upper portion of the maintenance hole upon inflation. The cover additionally has surface means or portions which overlap the upper portions of the manhole to provide a deflection dam for water or other contaminants which may run down an inclined street or road surface to block entry to the inside of the maintenance hole. Conduits, cables, hoses, and other connections which may remain in place will be sealed by the inflatable balloon, which can merge itself on and fit around the conduits. The seal may not be entirely water-tight; it is sufficient, however, to prevent severe flooding of the maintenance hole and, when properly placed, for example at the downhill side of an inclined street, provides sufficient tightness so that, effectively, ingress of water or contaminants to the maintenance hole is prevented.

In accordance with features of the invention, the balloon can be in form of a tire, with a web extending across the circumference of the tire, the tire fitting within the maintenance hole and, upon inflation, tightly engaging the outer portions of the maintenance hole wall, and wrapping itself, under air pressure, against conduits or hoses which may run over the edge of the maintenance hole for emergency supply of utility services. The web may be a multi-ply structure, or formed with air channels which, likewise, will be inflated.

For inflation, a valve, similar to an automobile tire or bicycle tire valve, is placed on the balloon, so that it can be inflated by a hand pump, by compressed air available from a utility truck compressor, or the like.

The emergency cover has the advantage that, when uninflated, it is light, can be rolled up so that it takes only little space in an emergency vehicle, while providing an effective barrier to the ingress of water, contaminants, or, with a web, to animals, such as rats, into the maintenance hole when it is unattended, yet permitting emergency utility supplies to run over the edge of the maintenance hole without possibility of damage thereto by the cover. Preferably, it is made of distendable, flexible material such as rubber.

DETAILED DESCRIPTION

Figure 1:
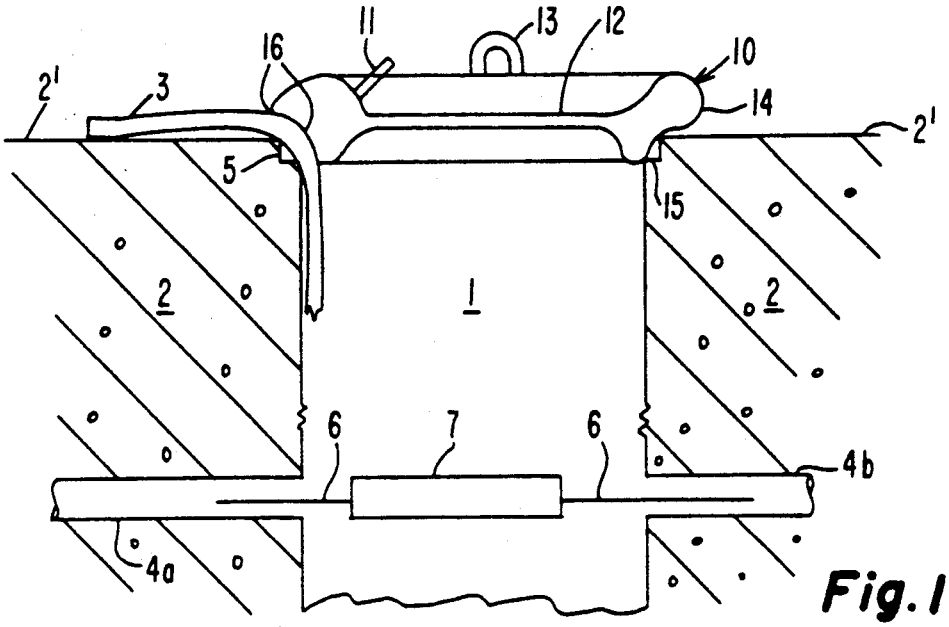
FIG. 1 is a highly schematic cross-sectional view of a maintenance hole with a cover applied thereover, and illustrating placement of the cover against an electrical cable passing over the edge of the maintenance hole.
Figure 2:
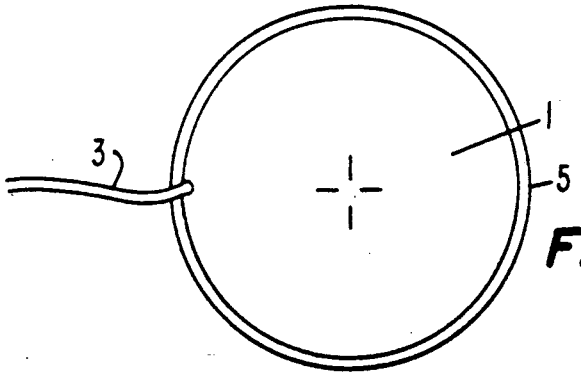
FIG. 2 is a top view of the maintenance hole, omitting the cover.

A maintenance hole 1 is sunk into a street shown generally at 2. Emergency electrical cables 3 are passed over the edge 5 of the manhole. This edge 5, normally, is formed with an abutment or a stepped edge to permit placement of a steel or other heavy metal cover on the maintenance hole. Under emergency conditions, however, and when cables or hoses 3 are run over the edge 5, such a cover might cut into the insulation, particularly if, inadvertently, a vehicle passes over the cover, causing severe damage to the cables and possible cutting of the insulation and electrically dangerous conditions. Conduits **4*a* and 4*b* extend from the maintenance hole; conduit 4*a* may be connected to a building adjacent the street where the maintenance hole is placed; conduit 4*b* may be a supply conduit. The cable 6** has an electrical element 7 in the maintenance hole. The element 7 may be a splice, a fuseable link, or other electrical connection or device which should be accessible for maintenance or repair. A plurality of conduits 4*a* may extend from the maintenance hole, all fed by a common feeder cable from conduit 4*b*, and spliced by splice 7.

If electrical trouble develops between the feeder cable in supply or feeder conduit 4*b* and any one of the distribution cables in conduits 4*a*, it is customary to make an emergency connection at the splice 7 and run emergency cables 3 over the edge 5 of the maintenance hole and over land surface 2'.

In accordance with the present invention, the maintenance hole can be closed temporarily by placing a balloon 10, and inflating the balloon. The balloon has a valve 11, and may take the form of a tire or donut-shaped element, in which the inner walls of the tire are connected by a cross web 12. The cross web 12 may be a single piece of material, such as plasticized fabric, rubber, plastic or the like. One or two handles 13 are secured to the cover, for example to the outer tire, although their location is not critical. Alternatively, the cross web 12 may be a multiple structure, leaving an air connection between the outer rim or donut, as shown in FIG. 1.

As best seen in FIG. 1, the balloon tire has outer surface wall portions 14 which overlap the rim of the maintenance hole and surface portions 15 which seal themselves against an upper region of the maintenance hole where the balloon rim engages the rim 5 of the maintenance hole. Where the cables 3 are located, passing over the rim 5, the balloon 10 will form itself with surface portions or regions 16 fitting against and passing around the cables, engaging the cables or conduits 3 by the force of air compressed within the tire 10 due to the inflation thereof.

Figure 5:
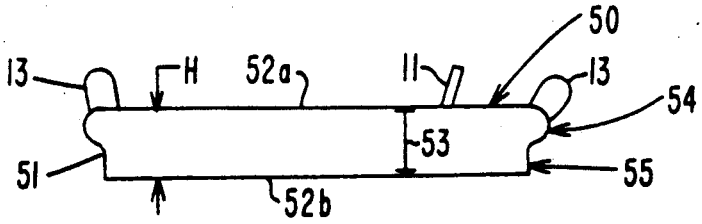
FIG. 5 is a cross-sectional view through another embodiment of the balloon.

For some applications, the cover 50 can be made in form of a generally hollow disk-shaped balloon 51 (see FIG. 5), having handles 13 formed at the outer edge. The disk-shaped balloon can have pre-formed surfaces 55 fitting within the maintenance hole, with the overlap surfaces 54 being pre-formed to bulge outwardly. Upon inflation of the entire structure, see FIG. 5, the cover will fit within the maintenance hole and engage around cables or hoses 3, or the like.

If the dimension H (FIG. 5) is such that outward bulging of the cross web portions 52*a*, 52*b* can be expected, internal reinforcement or holding strips 53 can be secured within the structure, for example by plastic welding, to provide structural stability and cohesion to the entire balloon, even when it is inflated.

Figure 6:
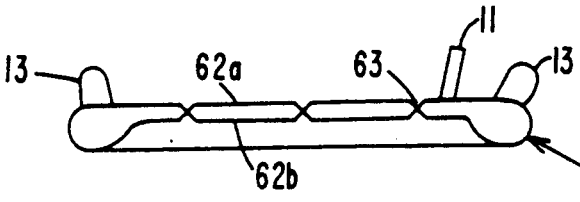
FIG. 6 is a cross-sectional view through yet another embodiment of the balloon.
Figure 7:
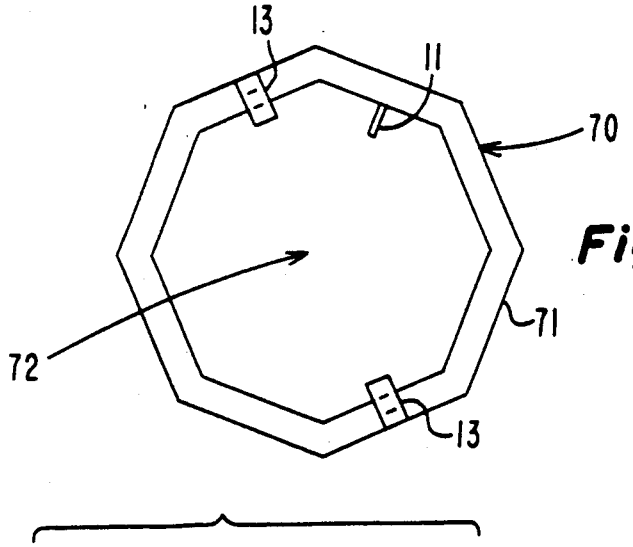
FIG. 7 is a top view of a limp maintenance hole cover having a polygonal configuration, suitable for example for both round and square maintenance holes.

FIG. 6 illustrates another cover 60 in which the upper and lower web portions 62*a*, 62*b* are interconnected by welding seams 63, such constructions being well known, for example in the bottoms of rubber rafts or the like.

The cross element 12 need not be made of fabric, plastic or the like; it need not be integral with the outer balloon, but could be a piece of plywood, or other similar structural element. If a piece of plywood is used, the balloon can be in form of a tire, fitting partly into the manhole, with the balloon then lightly inflated, just enough to give it shape, and then seating the plywood therein, for subsequent tighter inflation to pinch the plywood between bulges which will form themselves as the balloon is inflated and distends. This is not a preferred arrangement since two elements are then used, of which one can get lost, and more handling is required.

Figure 3:
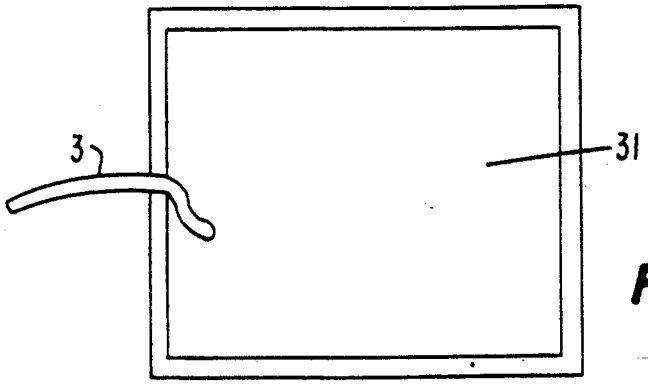
FIG. 3 is a top view of another maintenance hole, with a rectangular configuration.
Figure 4:
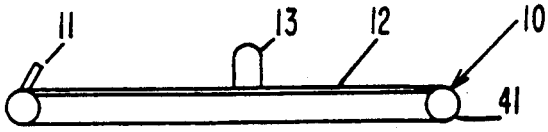
FIG. 4 is a schematic cross-sectional view of one embodiment of the balloon.

The plan outline of the balloon can be circular, which will fit most circular maintenance holes within a predetermined size range. By inflating the balloon more or less, different sizes of maintenance holes, within an inflation pressure range, can be accommodated. Some maintenance holes are square or otherwise polygonal. For such maintenance holes, the unit 70 may be desirable, which is octogonal. Thus, it will fit circular maintenance holes by smoothing out the corners upon inflation, and will also fit square maintenance holes, such as the maintenance hole 31 (FIG. 3), by engagement with four corners.

Figure 8:
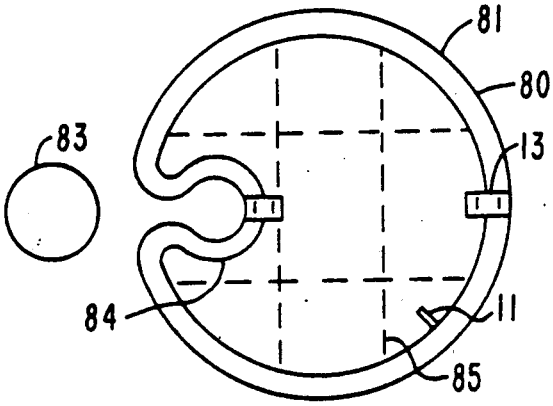
FIG. 8 is a top view of a maintenance hole cover, inflated, and specially adapted for use around an air hose, shown separately, passing into the maintenance hole.

In some instances, it is desirable to provide a cover for a maintenance hole and leave in place an air supply conduit or air supply hose which is customarily used to supply air to personnel working in a pit beneath or connected to the maintenance hole. For such constructions, the unit 80 (FIG. 8) is desirable, which is formed with an indentation or inward bulge 84 in the rim 81, large enough so that, when limp, it can wrap itself around an air hose 83. Upon inflation, the indentation 84 will contract. FIG. 8 shows the inflated cover 80, with the air hose 83, however, removed, in exploded representation. Preferably, such covers are cross-sealed or cross-connected as explained in connection with FIG. 5 or 6, as shown schematically by the broken lines 85.

The cross web, in most instances, will not be strong enough to support the weight of a person. It depends on the pressure within the cover, that is, on the extent of inflation, and the extent of overlap of the surface 14,54 over the rim of the manhole. The cover, thus, should have an indication that it is not to be stepped on, as shown in FIG. 8.

The invention has been explained in connection with electrical cables 3. It is, of course, equally applicable to gas hoses provided for temporary connection, or any other external connections into a maintenance hole where the maintenance hole should be closed without, however, interfering with the integrity of cables, hoses, conduits or the like, passing over the edge of the maintenance hole, while reliably excluding water, contaminants, animals or the like.

The hollow circumferential portions 41, 51, 61, 71, 81 of the balloon can be unitary with the web 12, 52*a*, 52*b*, 62*a*, 62*b*, 72, particularly if made of plastic or rubber-type material; the web may, however, also be a separate element connected thereto in a suitable manner. If the web is self-supporting, for example formed by a piece of plywood or the like, it can be self-holding within the circumferential portions when they are inflated.

Various changes and modifications may be made, and any features described herein may be used with any of the others, within the scope of the inventive concept.

I claim:

1. For combination with a maintenance hole (1, 31) in a land surface (2'), an emergency water deflector for the maintenance hole, comprising an inflatable balloon (10, 50, 60, 70, 80) having a plan configuration and dimension fitting in part into the maintenance hole and having the form of a hollow, ring-shaped inflatable tire-like structure, said balloon defining hollow circumferential portions (41, 51, 61, 71, 81) dimensioned to fit, when limp and uninflated, into an upper portion of the maintenance hole, said hollow circumferential portions having a first surface portion (15) positioned for sealing itself against a wall surface within said upper portion of the maintenance hole and further surface portions (14) extending laterally outwardly of said first surface portion and positioned for overlapping said upper portion and said land surface (2'), thereby substantially sealing the circumference of the maintenance hole and providing a deflection dam to prevent ingress of water and contaminants when inflated.

2. The combination of claim 1, in further combination with cable, hose or conduit means (3, 83) extending from the maintenance hole (1, 31) to the outside thereof and over an edge (5) of the maintenance hole, said circumferential portions (41, 51, 61, 71, 81) of the cover further comprising conduit engaging surface means (16), which conduit engaging surface means, upon inflation of said cover, engage around said conduit means (3, 83) and for sealing itself against said upper portions of the maintenance hole except where the conduit means passes over the edge of the maintenance hole.

3. The combination of claim 1, wherein said circumferential portions (41, 51, 61, 71, 81) and said web (12) comprise a unitary structure of resiliently inflatable, extendable material.

4. The combination of claim 1, wherein said hollow circumferential portions are, essentially, in the shape of a tire or donut.

5. The combination of claim 1, wherein said web is a hollow, dual wall structure pneumatically coupled to said hollow circumferential portions and inflatable upon inflation of the circumferential portions.

6. The combination of claim 5, further including reenforcement strips (53) between the walls of the dual wall web.

7. The combination of claim 5, including coupling seams (63) connecting the walls of the dual wall structure and forming channel means therein, and means for inflating said channel means and placing them under air pressure.

8. The combination of claim 7, wherein said means for inflating the channel means comprise a pneumatic connection between said hollow circumferential portions and said channel means.

9. The combination of claim 1, wherein said plan configuration of the ring-shaped, tire-like structure forming the inflatable balloon is essentially circular.

10. The combination of claim 1, wherein said plan configuration of the ring-shaped, tire-like structure forming the inflatable balloon is polygonal.

11. The combination of claim 1, wherein said plan configuration of the ring-shaped, tire-like structure forming the inflatable balloon is essentially circular.

12. The combination of claim 1, wherein said plan configuration of the inflatable balloon is essentially circular with an inwardly projecting bulge (84) defining a recess, merging with said circumferential portions to accommodate a conduit placed in said recess.

13. The combination of claim 1, including handle means (13) connected to said inflatable balloon for placement of the balloon and handling prior to and during inflation.

14. The combination of claim 1, further including valve means (11) coupled to the inflatable balloon for inflating said circumferential portions and essentially sealingly engaging the first surface portion (15) and said further surface portions (14) against and over the upper portions of the maintenance hole.

15. The combination of claim 1, including a web (12) extending between said hollow circumferential portions.

16. The combination of claim 13, including a web (12) extending between said hollow circumferential portions.

17. The combination of claim 15, including a web (12) extending between said hollow circumferential portions.

18. A method of temporarily sealing a maintenance hole utilizing an inflatable balloon, wherein said inflatable balloon has a plan configuration and dimension fitting, in part, into the maintenance hole, said balloon defining hollow circumferential portions (41, 51, 61, 71, 81) dimensioned to fit, when limp and uninflated,, into an upper portion of the maintenance hole, comprising the steps of placing the inflatable balloon partly into an upper portion of the maintenance hole; and inflating said inflatable balloon to form a first surface portion (15) sealing itself against a wall surface within said upper portion of the maintenance hole and a further surface portion (14) which overlaps the upper portions and the edge (5) of the maintenance hole to form a seal against the edge of the maintenance hole and a deflection dam thereabout and engage against the land surface (2') in which the maintenance hole is placed.

19. A method of temporarily sealing a maintenance hole over an edge (5) of which conduit means (3, 83) extend, utilizing an inflatable balloon, wherein said inflatable balloon has a plan configuration and dimension fitting, in part, into the maintenance hole, said balloon defining hollow circumferential portions (41, 51, 61, 71, 81) dimensioned to fit, when limp and uninflated, into an upper portion of the maintenance hole, comprising the steps of placing the inflatable balloon partly into an upper portion of the maintenance hole; and inflating said inflatable balloon to form a first surface portion (15) sealing itself against a wall surface within said upper portion of the maintenance hole and a further surface portion (14) which overlaps the upper portions and the edge (5) of the maintenance hole to form a seal against the edge of the maintenance hole and a deflection dam thereabout and engage against the land surface (2') in which the maintenance hole is placed, said surface portion forming a conduit engagement region fitting against and passing around said conduit means (3, 83).

* * * * *